US007542056B2

(12) United States Patent
Oh

(10) Patent No.: US 7,542,056 B2
(45) Date of Patent: Jun. 2, 2009

(54) METHOD FOR CONTROLLING BRIGHTNESS LEVEL OF A DISPLAY

(75) Inventor: Jang Geun Oh, Suwon-si (KR)

(73) Assignee: LG Electronics Inc., Seoul (KR)

( * ) Notice: Subject to any disclaimer, the term of this patent is extended or adjusted under 35 U.S.C. 154(b) by 784 days.

(21) Appl. No.: 10/621,369

(22) Filed: Jul. 18, 2003

(65) Prior Publication Data

US 2004/0061708 A1 Apr. 1, 2004

(30) Foreign Application Priority Data

Sep. 30, 2002 (KR) ..... 10-2002-0059340

(51) Int. Cl.
*G09G 5/10* (2006.01)

(52) U.S. Cl. ..... 345/690; 345/102

(58) Field of Classification Search ..... 345/690, 345/101, 102, 87, 204, 213; 356/213, 214, 356/218–223, 226–228, 121–127
See application file for complete search history.

(56) References Cited

U.S. PATENT DOCUMENTS 5,394,167 A * 2/1995 Migny ..... 345/690
5,786,801 A * 7/1998 Ichise ..... 345/102
5,933,130 A * 8/1999 Wagner ..... 345/690
6,094,185 A * 7/2000 Shirriff ..... 345/102
6,188,380 B1 * 2/2001 Kawashima et al. ..... 345/102
6,411,306 B1 * 6/2002 Miller et al. ..... 345/690
6,559,826 B1 * 5/2003 Mendelson et al. ..... 345/102
6,611,249 B1 * 8/2003 Evanicky et al. ..... 345/102
2003/0035020 A1 * 2/2003 Menendez et al. ..... 347/37
2003/0043106 A1 * 3/2003 Woo ..... 345/101
2003/0058202 A1 * 3/2003 Evanicky et al. ..... 345/82

* cited by examiner

*Primary Examiner*—Amr Awad
*Assistant Examiner*—Stephen G Sherman
(74) *Attorney, Agent, or Firm*—KED & Associates, LLP

(57) ABSTRACT

Disclosed is an apparatus and method for controlling a brightness level of a liquid crystal display. A brightness sensor is used to detect the brightness of the LCD. A control code value corresponding to the sensed brightness level is then set for the LCD. The control code information is then used to variably control the brightness of the LCD at an appropriate level.

16 Claims, 8 Drawing Sheets

FIG. 3

(Relative Optical Characteristic: Bad) (Relative Optical Characteristic: Good)

| LCD #A | | | | LCD #B | | | |
|---|---|---|---|---|---|---|---|
| LCD Brightness Level | LCD Brightness Spec | Control Code | Invertor Watt | LCD Brightness Level | Control Code | LCD Brightness Spec | Invertor Watt |
| 1 | 10 nit | 10 | 1.0 | 1 | 10 | 15 nit | 1.1 |
| 2 | 20 nit | 20 | 1.2 | 2 | 20 | 27 nit | 1.25 |
| 3 | - 30 nit - | 30 | 1.5 | 3 | 30 | 40 nit | 1.5 |
| 4 | 50 nit | 50 | 1.8 | 4 | 50 | 65 nit | 1.85 |
| 5 | 70 nit | 80 | 2.2 | 5 | 80 | 95 nit | 2.2 |
| 6 | 90 nit | 90 | 2.6 | 6 | 90 | 105 nit | 2.6 |
| 7 | 110 nit | B0 | 3.0 | 7 | B0 | 130 nit | 2.9 |
| 8 | 130 nit | D0 | 3.5 | 8 | D0 | 150 nit | 3.4 |

LCD A,B : Control code same

LCD A,B : Brightness different

FIG. 4

| Address | No. bytes | | Description | Format |
|---|---|---|---|---|
| 00h | 1 | Bytes | EDID Structure Version/Revision | Binary |
| 01h | 7 | Bytes | Vendor/Product Identification | |
| 01h | | 2 | ID Manufacturer Name | EISA 3-character ID |
| 03h | | 2 | ID Product Code | Vendor assigned code |
| 05h | | 1 | Week of Manufacture | Week number |
| 06h | | 2 | Year of Manufacture | Binary |
| 4Fh | 5 | Bytes | Display Device Description | |
| 4Fh | | 1 | Display Technology Type/Subtype | |
| 50h | | 1 | Major Display Characteristics | |
| 56h | 28 | Bytes | Color/Luminance Description | |
| 56h | | 4 | Display Transfer Characteristic (Gamma) | Binary |
| 80h | 127 | Bytes | Luminance Table & Timing Descriptions | |
| * | | x*A | Luminance Table | Size x specified in Section 4.4 |
| * | | 8*B | Range Limits | |
| * | | 27*C | 27-Byte-Detailed Range Limits | |
| * | | 4*D | 4-Byte Timing Codes | |
| * | | 18*E | 18-Byte Detailed Timing Descriptions | |
| * | | X | X=127-(x*A+8*B+27*C+4*D+18*D) | Set to 00h |

FIG. 6

| LCD #B' | | | |
|---|---|---|---|
| LCD Brightness Level | Control Code | LCD Brightness Spec | Invertor Watt |
| 1 | 0B | 10 nit | 0.9 |
| 2 | 1A | 20 nit | 1.1 |
| 3 | 29 | 30 nit | 1.3 |
| 4 | 47 | 50 nit | 1.6 |
| 5 | 75 | 70 nit | 1.8 |
| 6 | 84 | 90 nit | 2.2 |
| 7 | A2 | 110 nit | 2.5 |
| 8 | C1 | 130 nit | 3.0 |

'Control Code' Resetting

FIG. 8

| Level | PWM Control Code | Brightness |
|---|---|---|
| 1 | 10 | 10 Nit |
| 2 | 20 | 15 Nit |
| 3 | 30 | |
| ⋮ | ⋮ | |
| 8 | 80 | |

METHOD FOR CONTROLLING BRIGHTNESS LEVEL OF A DISPLAY

BACKGROUND OF THE INVENTION

1. Field of the Invention

The present invention relates to an apparatus and method for controlling the brightness level of a display, and more particularly, to an apparatus and method for controlling the brightness level of a liquid crystal display in an electronic device such as a notebook computer.

2. Description of the Related Art

Generally, a notebook computer providing a portable convenience is provided with a liquid crystal display (LCD) integrally constructed with a main body. The LCDs can be fabricated or produced in various kinds and sizes according to manufacturers.

FIG. 1 is a block diagram of a general computer system provided with an LCD coupled thereto.

As shown in FIG. 1, an inverter power is supplied to the LCD through an inverter cable under the control of a microprocessor. The brightness of the LCD is controlled regardless of manufacturer or the LCD's characteristics.

LCDs manufactured by different suppliers have different sizes and have different inherent optical characteristics. In a conventional LCD a cold cathode fluorescent lamp (CCFL) device is provided at an upper side or a lower side as a light emitting device. The CCFL device emits light in response to a high voltage applied through the inverter, which controls the brightness of the LCD.

The CCFL devices also have different inherent optical characteristics according to the manufacturers. However, the manufacturers producing notebook computers use the same inverter to operate all CCFL devices equipped in various LCDs, regardless of the particular characteristics of the CCFL devices.

Because the LCDs and the CCFL devices have different inherent optical characteristics, although an equal level of power is applied to the CCFL devices by the use of the same inverter, the brightness levels are different depending on the individual device characteristics.

Even when the LCDs and the CCFL devices are manufactured by a single manufacturer, and even though they employ the same inverter, the brightness levels of the LCDs may be different because of small differences between individual devices.

In order to solve the aforementioned problems and maintain the brightness of the LCDs at a constant level, the power applied to the CCFL device through the inverter is set based on the assumption that the LCD has relatively bad optical characteristics. In this case, an LCD having relatively good optical characteristics will operate at an unnecessarily high brightness level. This wastes battery power, and can dazzle a user's eye.

For instance, when it is assumed that in notebook computers using the same inverter, the appropriate brightness level is 30 nit (Cd/m$^2$), an LCD #A having relatively bad optical characteristics needs 2 Watts of power to maintain the brightness level at 30 nit. However, an LCD #B having a relatively good optical characteristics needs only 1.5 Watts of power. In spite of the above fact, the manufacturers set the consumption power applied to both LCD #A and LCD #B at 2 Watts to ensure that all computers will output 30 nit. Because of this, the LCD #B wastes the power of 0.5 Watts ineffectively, and too bright a picture is outputted on the screen of computer #B.

SUMMARY OF THE INVENTION

Accordingly, the present invention is directed to an apparatus and method for controlling a brightness of a display that substantially obviates one or more problems due to limitations and disadvantages of the related art.

An object of the present invention is to provide an apparatus and method for controlling a brightness of a display. A device embodying the invention includes a sensor for detecting the brightness of an LCD. The device may be a portable electronic device such as a notebook computer, a PDA, and a cellular phone. A device embodying the invention variably controls the brightness of the LCD at an optimum level with reference to the brightness detected by the sensor.

An apparatus embodying the invention utilizes a sensor for measuring the brightness of the display. A memory is provided in the display for storing brightness level information therein. A control part outputs a corresponding brightness level control signal by using the brightness level information. An adjusting part adjusts the brightness of the display according to the control signal.

A method embodying the invention includes the steps of reading out a brightness level control information stored in a memory unit, measuring the brightness of the liquid crystal display using a sensor, and variably setting the brightness level control information which is stored in the memory with reference to the brightness measured by the sensor.

In devices and methods embodying the invention it is possible to control the brightness of the LCD at an appropriate level, and thereby prevent the unnecessary consumption of power.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings:

FIG. 3 is a table showing brightness level control information so as to illustrate a brightness level control method of an LCD embodying the invention;

FIG. 4 shows a format of EDID (Extended Display Identification Data) configured in VESA regulation and including brightness level control information of an LCD;

FIG. 6 is a table showing the brightness level control information of an LCD embodying the present invention;

FIG. 8 is a table showing brightness controlled by the method shown in FIG. 7 in each level, and control codes corresponding the controlled brightness.

DETAILED DESCRIPTION OF PREFERRED EMBODIMENTS

Reference will now be made in detail to the preferred embodiments of the present invention, examples of which are illustrated in the accompanying drawings.

Figure 1:
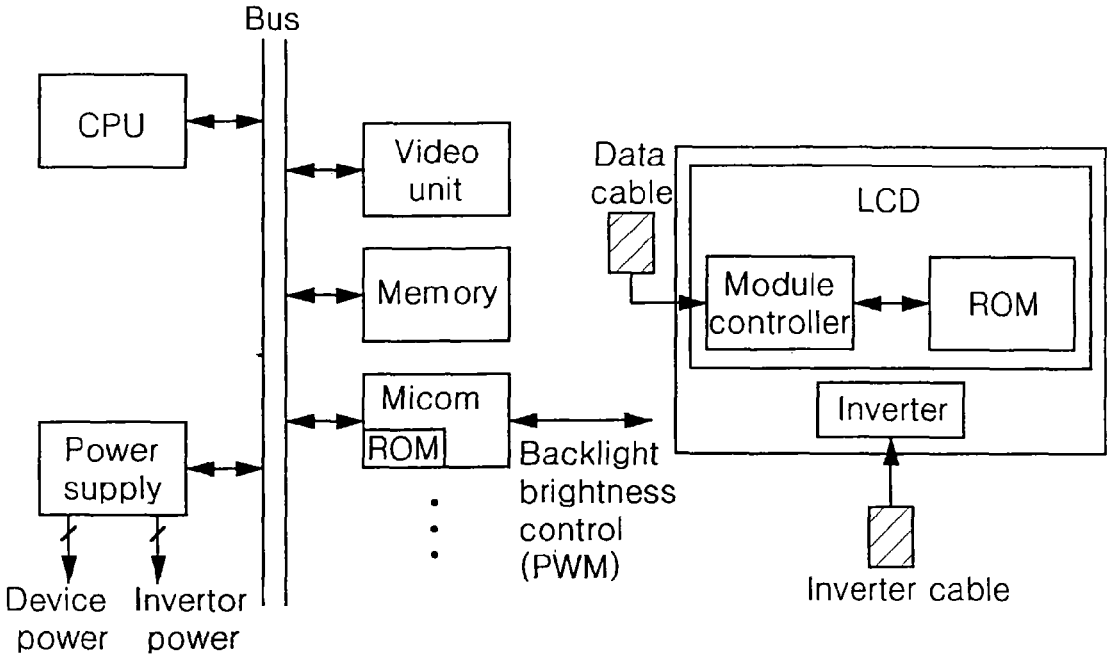
FIG. 1 (Related Art)
FIG. 1 is a block diagram of a general computer system provided with an LCD.
Figure 2:
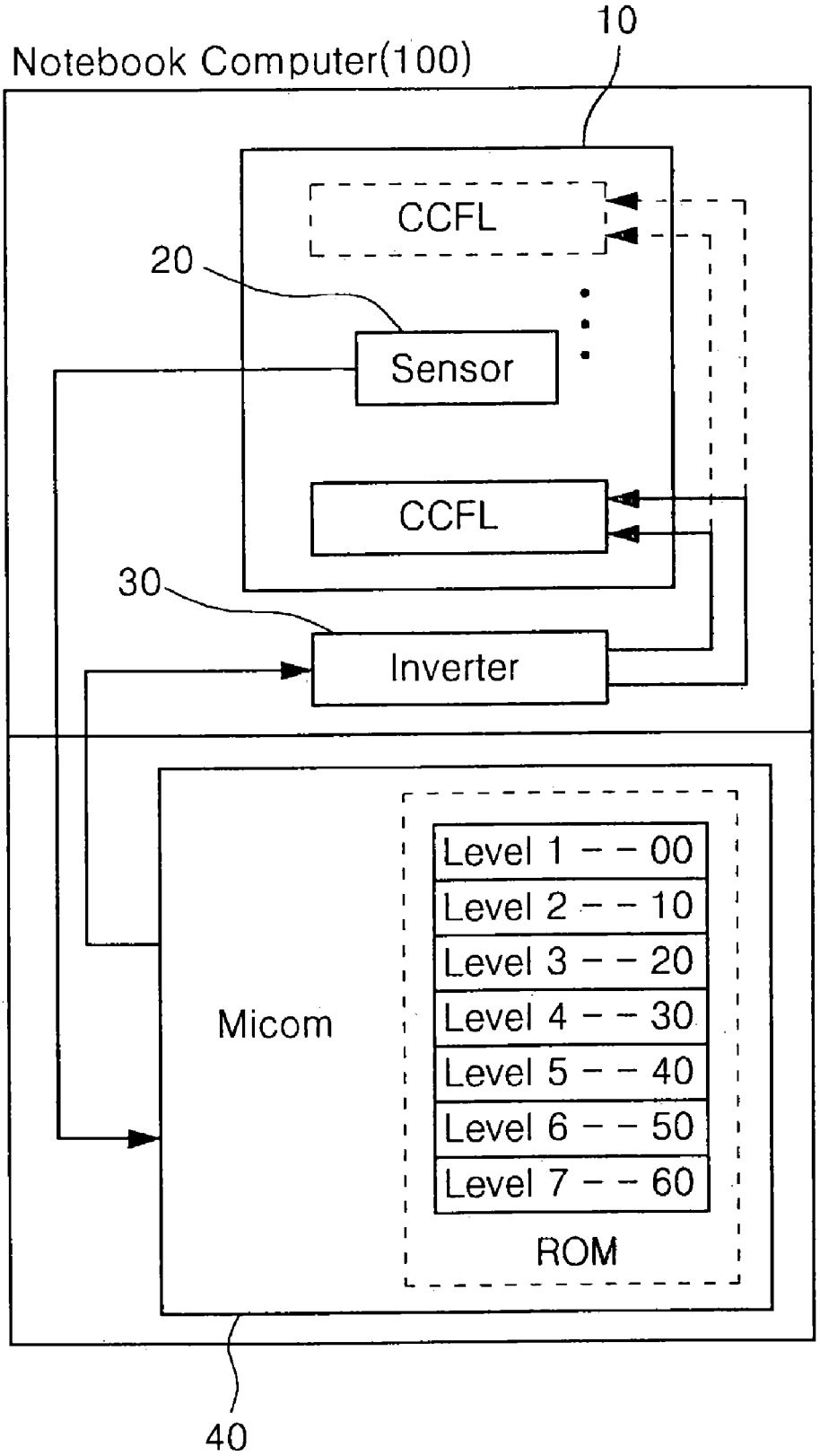
FIG. 2 is a block diagram schematically showing a construction of a notebook computer to which a brightness level control method embodying the invention is applied.

FIG. 2 is a block diagram schematically showing a construction of a notebook computer to which a brightness level control method of an LCD according to the invention is applied. The notebook computer 100 includes an LCD 10, a sensor 20, an inverter 30 and a microcomputer 40. The LCD 10 also includes a CCFL device arranged at an upper side or lower side thereof.

The sensor 20 is fixedly or movably installed at a center or one side of the LCD 10 to detect the brightness of the LCD 10. The sensor would then output an electrical signal indicative of the brightness. As the sensor 20, a passive device such as a small-sized photodiode can be used.

When the brightness control procedure has been finally completed by using the detected brightness, the movable sensor 20 can be configured to be equipped in an outer case invisibly and/or to be again used for detecting the brightness level around a PDA or the like, for instance.

In addition, the sensor 20 may be configured in the form of a jig in the production line. In this instance, the sensor 20 may be provided with a connector configured to connect with the microcomputer 40 so as to output a brightness value measured by the sensor 20. Alternatively, the sensor 20 may be configured in a movable structure.

The inverter 30 variably controls a high voltage of power applied to the CCFL device serving as a back light lamp of the LCD 10 according to the control of the microcomputer 40. The microcomputer 40 reads out brightness level information stored in an inner memory to control the operation of the inverter 30.

The inverter 30 may be controlled by a system BIOS (Basic input output system) (not shown) or an operating system.

In other words, whenever a user presses a brightness control button, for instance, the increase or decrease key on a keyboard, a SMI (System management interrupt) or SCI (system configuration interrupt) is generated. If a SMI or SCI is generated, an SMI handler of a corresponding system bios or a corresponding routine of the operating system can control the brightness level control information of the inverter 30.

FIG. 3 is a table showing brightness level control information.

The microcomputer 40 variably sets the brightness level control information that is stored in advance with reference to electrical signals detected by the sensor 20. For instance, the brightness level control information of the LCD includes an LCD brightness level, an LCD brightness specification, control codes and inverter power. This information can be stored in a combined structure. The control codes are variably set as arbitrary values by the microcomputer 40, system BIOS or operating system.

If the control codes of the brightness level control information of an LCD #A and an LCD #B having different optical characteristics were set to be the same values, LCD #B, which has good optical characteristics relative to LCD #A, would attempt to perform the same brightness control operation as LCD #A. However, the brightness level of LCD #B would exceed an appropriate brightness, so that power would be wasted and a user's eye may be influenced badly.

The brightness level control information of an LCD includes an LCD brightness level, an LCD brightness specification, control codes and inverter power. This information can be defined in an EDID (Extended display identification data) format under the regulation of VESA. Such EDID information can be stored in an inner memory of the LCD.

For instance, when the manufacturers set the brightness control information to correspond to the vendor/product ID of each LCD, the system bios, operating system or microcomputer can read out the brightness control information through the LCD interface and store the read brightness control information in the system memory. It is possible to control a corresponding brightness from the stored information.

In other embodiments, when the LCD as a host writes the brightness control information in the system memory, the system can use the recorded information to control a corresponding brightness.

In addition, brightness level information corresponding to when the LCD is in a high temperature state can be provided within the EDID specification. This information is provided because as the temperature of the LCD rises, the brightness level rises too.

In order to provide the LCD with brightness level information related to high temperature in the EDID specification, a temperature sensor is also installed. The LCD temperature information sensed by the temperature sensor is provided to the system through the interface.

When a user continues to use the system, the system bios, operating system or microcomputer can periodically check the temperature and use the brightness level information related with the high temperature characteristic, and the sensed temperature, to control the brightness of the LCD. By doing so, when the temperature of the LCD rises to a high temperature, unnecessary power consumption is saved to thereby extend the battery life.

Figure 5:
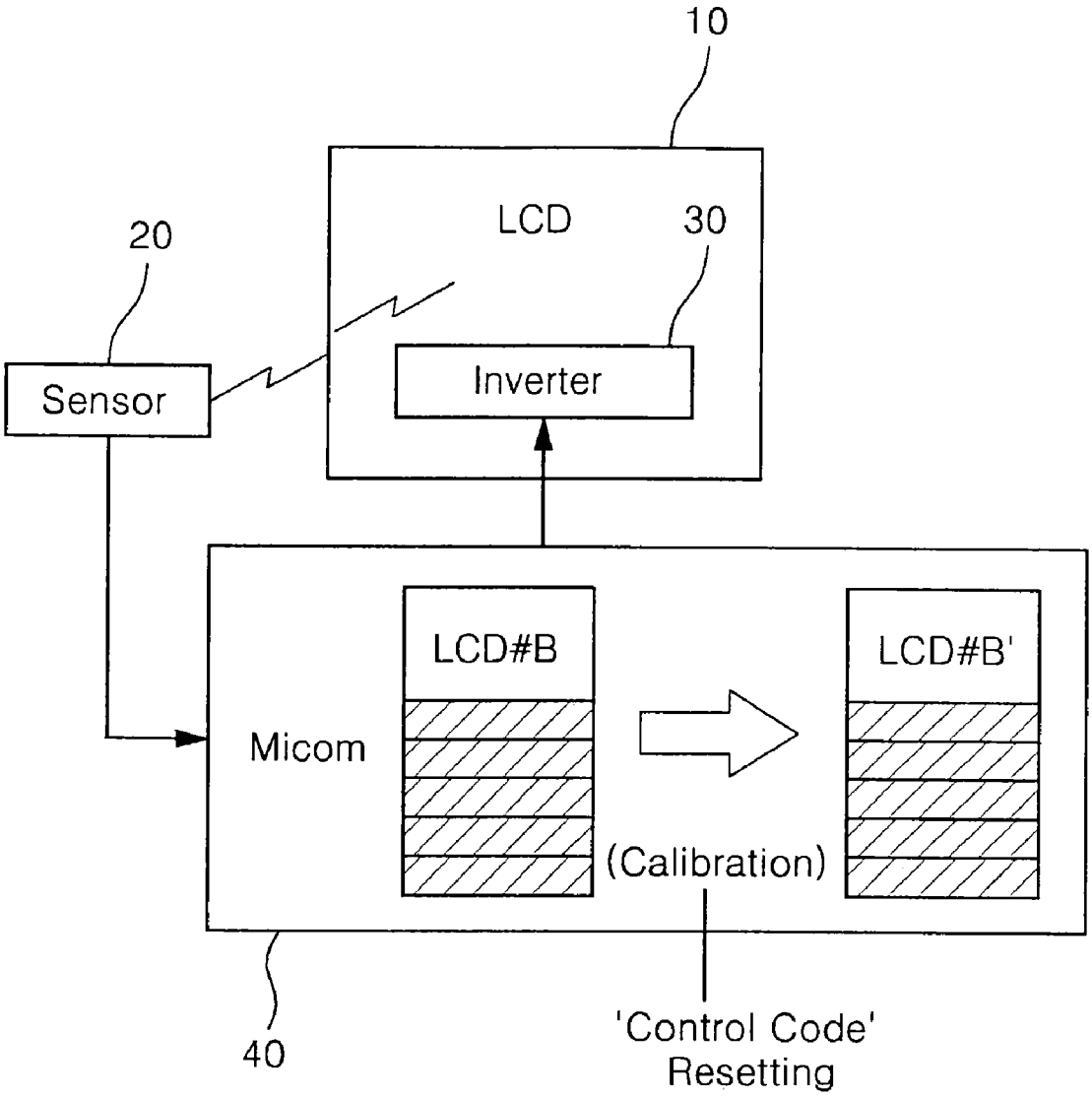
FIG. 5 is a block diagram for schematically illustrating a brightness level control method of an LCD embodying the present invention.

Accordingly, as shown in FIG. 5, the microcomputer 40 reads out and confirms a control code selected and designated by a user from the brightness level control information of the LCD which is stored in advance. The microcomputer then outputs a control signal corresponding to the read control code to the inverter, controls the power applied to the LCD, for instance, LCD #B to an appropriate level, and confirms the brightness of the LCD measured by the sensor 20.

Then, with reference to the confirmed brightness, it performs a series of control code reset operations to variably set the values of the control codes. For instance, in case of LCD #B of FIG. 3, if the value of the sensed brightness of the LCD at current level L1 (control code: 10, Spec: 10 nit) is 15 nit (e.g., 1.1 watt), the microcomputer controls the code value until the sensed brightness value decreases to 10 nit gradually and finely. In an example of FIG. 6, it is shown that the code value is adjusted to 0.9 watt.

At this time, the set code values are newly added to the code table and the respective brightness levels 1 to 8 are optimized in this manner so that a new code table suitable for the current LCD is made.

Accordingly, as shown in FIG. 6, the reset control codes become a new code controlling the inverter variably. The new codes optimize a power supplied to the LCD, so that the brightness of the LCD is adjustable to an appropriate level. Additionally, inefficient power consumption can be prevented. The system can also adjust a corresponding brightness of the LCD by using the brightness information that is set in the EDID specification in advance.

Meanwhile, the micom 40 resets the brightness level control information of the LCD and selectively carries out the operation of variably controlling the inverter by a user's key input, thereby preventing a continuous consumption of the power required for the brightness adjustment operation.

Figure 7:
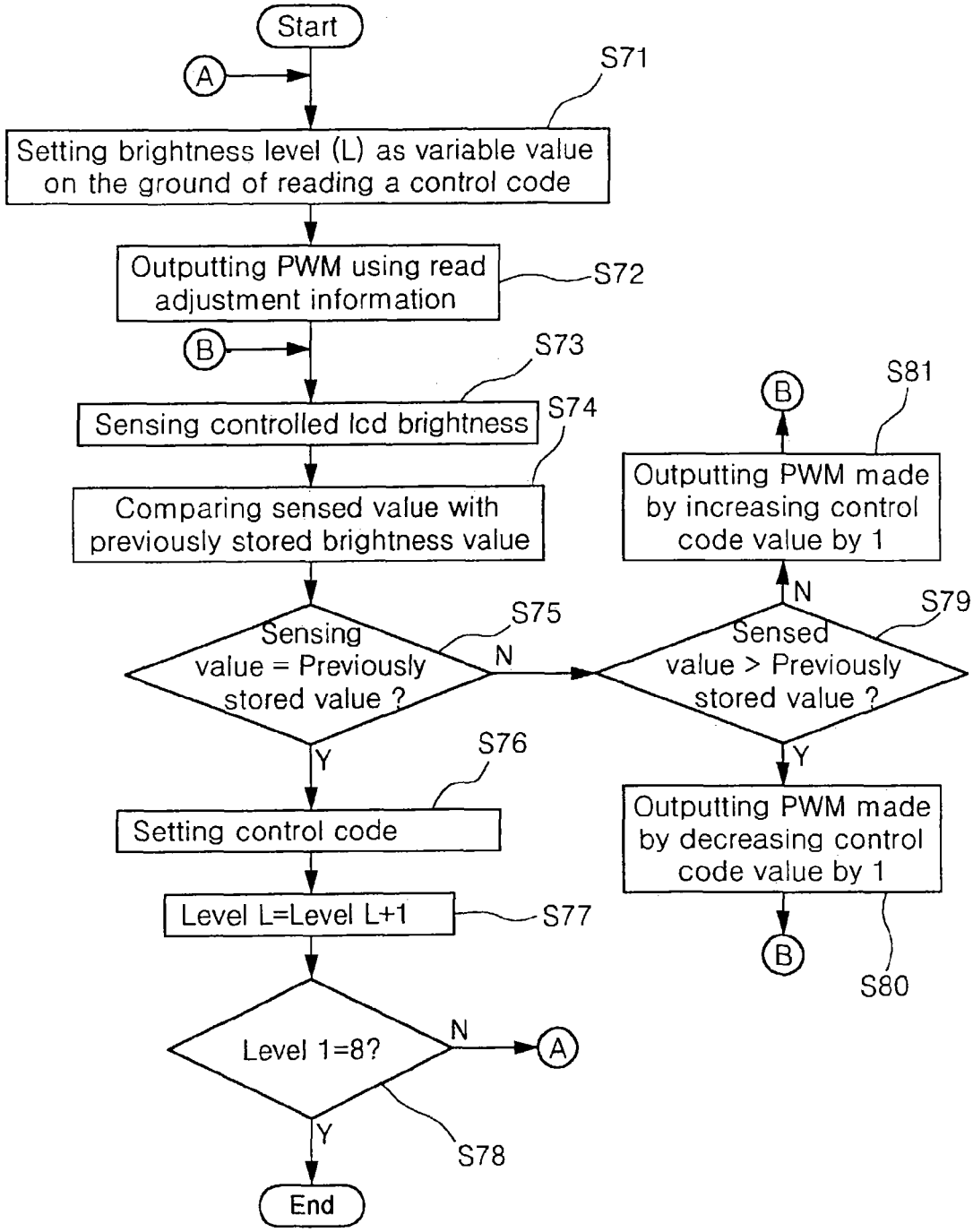
FIG. 7 is a flowchart illustrating a brightness level control method embodying the invention.

FIG. 7 is a flowchart illustrating a brightness level control method in which the tables of FIGS. 3 and 6 and manufactures are considered.

Referring to FIG. 7, a control code value is read out and a level L1 is set as a variable value (S71). In other words, among the variables having one or more brightness levels, a value of a predefined level or an arbitrary level is set as a variable value.

A pulse width modulation (PWM) type control code corresponding to the read information is outputted (S72). The control code is converted into a binary code and used as information.

The adjusted LCD brightness is then sensed by a sensor (S73). The brightness value previously stored at the step S71 is compared with the actual brightness value sensed at the step S73 (S74). If both values are equal to each other, the control code is set and the process is performed with respect to next levels until the level 8 (S75, S76, S77, S78).

If the sensed value is greater than the previously stored value, the control code value is decreased by a predefined value (e.g., unity). Then, a PWM code value corresponding to the decreased control code value is outputted (S79, S80) and the process is repeatedly performed until the level=8.

However, if the sensed value is not greater than the previously stored value, the control code value is increased by a predefined value (e.g., unity). Then, a PWM code value corresponding to the increased control code value is outputted (S79, S81) and the process is repeatedly performed until the level=8.

FIG. 8 is a table showing the brightness and the corresponding control codes, in which the brightness is adjusted through the process of FIG. 7.

In addition to a notebook computer, the present invention is also applicable to various electronic equipments with an LCD, such as a personal digital assistant (PDA) and mobile communications equipment such as a cellular telephone.

In some embodiments of the invention, the brightness sensor can be incorporated into the device having the LCD screen. In these embodiments, the method shown in FIG. 7 can be periodically performed to periodically optimize the PWM Control Code values used to control the inverter. This allows the device to adjust the power applied to the inverter over time to always maintain the appropriate screen brightness.

In other embodiments of the invention, the sensor may be incorporated into a jig or fixture used during manufacture of the LCD screen. In these embodiments, the screen would be checked after it is manufactured to determine the appropriate settings that will result in optimal screen brightness. These brightness settings would then be stored in a memory of the LCD itself. The brightness settings will be then be accessed by a microprocessor that is later coupled to both the LCD screen and a power inverter to ensure that the power inverter supplies the optimal power to the LCD screen for each selected brightness setting.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A method of setting brightness control codes of a display, comprising:

driving the display;

sensing a brightness of the display;

adjusting the driving of the display until the display is driven at a predetermined brightness based on the sensed brightness; and setting an adjusted brightness control code corresponding to the predetermined brightness of the display, wherein the driving includes initially driving the display using a brightness control code provided by a display manufacturer, and wherein setting the adjusted brightness control code includes setting a new brightness control code corresponding to the predetermined brightness, the new brightness control code replacing the brightness control code provided by the display manufacturer, wherein the driving, sensing, adjusting and setting are performed a plurality of times to set a plurality of different brightness control codes corresronding to a plurality of different predetermined brightnesses.

2. The method according to claim 1, further comprising storing the plurality of brightness control codes in a memory of the display.

3. The method according to claim 1, further comprising storing the plurality of brightness control codes in at least one of a system BIOS, an operating system and a microcontroller of a computer system.

4. The method according to claim 1, wherein the setting comprises setting brightness control codes that indicate how to control an inverter that supplies power to the display.

5. The method according to claim 1, wherein the setting includes setting high temperature brightness control codes that provide information about how to control a brightness of the display when the display is operating at a high temperature.

6. The method according to claim 1, wherein the adjusting comprises changing a signal applied to an inverter that supplies power to the display to adjust a brightness of the display.

7. The method according to claim 1, wherein setting the new brightness control code includes increasing by 1 the brightness control code provided by the display manufacturer.

8. The method according to claim 1, wherein setting the new brightness control code includes decreasing by 1 the brightness control code provided by the display manufacturer.

9. The method according to claim 1, further comprising driving the display using the new brightness control code such that the display is driven at the predetermined brightness.

10. A method of controlling a display, comprising:

driving the display;

sensing a brightness of the display;

adjusting the driving of the display until the display is driven at a predetermined brightness based on a result of the sensed brightness;

setting an adjusted brightness control code corresponding to the predetermined brightness;

repeating the driving, sensing, adjusting and setting a plurality of times to set a plurality of different brightness control codes corresponding to a plurality of different predetermined brightnesses of the display; and using one of the brightness control codes corresponding to a desired brightness level to drive the display at the desired brightness level.

11. The method according to claim 10, wherein the using comprises using a brightness control code corresponding to the desired brightness level to control an inverter that supplies power to the display.

12. The method according to claim 10, wherein the brightness control codes are set after the display is driven at the predetermined brightness.

13. The method according to claim 10, wherein the plurality of different brightness control codes are provided in an EDID format.

14. The method according to claim 10, wherein setting the adjusted brightness control code includes increasing or decreasing a previous brightness control code by 1.

15. A method of setting brightness control codes of a display, comprising:

driving the display;

sensing a brightness of the display;

adjusting the driving of the display until the display is driven at a predetermined brightness based on the sensed brightness; and setting an adjusted brightness control code corresponding to the predetermined brightness of the display, wherein the driving includes initially driving the display using a brightness control code provided by a display manufacturer, and wherein setting the adjusted brightness control code includes setting a new brightness control code corresponding to the predetermined brightness, the new brightness control code replacing the brightness control code provided by the display manufacturer, wherein setting the brightness control code occurs after adjusting the driving of the display.

16. The method according to claim 15, wherein the new brightness control code is provided in an EDID format.

* * * * *